United States Patent [19]

Meigs

[11] 4,169,510

[45] Oct. 2, 1979

[54] DRILLING AND BELLING APPARATUS

[75] Inventor: Robert W. Meigs, Stavanger, Norway

[73] Assignee: Phillips Petroleum Company, Bartlesville, Okla.

[21] Appl. No.: 825,015

[22] Filed: Aug. 16, 1977

[51] Int. Cl.[2] ..... E21B 9/26

[52] U.S. Cl. ..... 175/65; 175/267; 175/318; 175/285

[58] Field of Search ..... 175/317, 284, 269, 265, 175/238, 242, 267, 65, 318, 285

[56] References Cited

U.S. PATENT DOCUMENTS

| | | | |
|---|---|---|---|
| 2,069,482 | 2/1937 | Seay | 175/269 |
| 2,679,383 | 5/1954 | Garrison | 175/269 |
| 2,872,160 | 2/1959 | Barg | 175/269 |
| 3,196,960 | 7/1965 | Kammerer | 175/267 |
| 3,757,876 | 9/1973 | Pereau | 175/267 |
| 3,757,877 | 9/1973 | Leathers | 175/269 |

*Primary Examiner*—William Pate, III

[57] ABSTRACT

A combination drilling and belling apparatus includes a frame having at one end a drilling area for drilling a borehole in the earth. A pair of belling arms are pivotally carried by the frame and are selectively movable between a drilling position and a non-drilling position. The belling arms have a drilling surface such that when the belling arms are moved to the drilling position and the apparatus is rotated, the belling arms same form an enlarged bell-shaped cavity. When the belling arms are in a non-drilling position, a valve means is provided for closing an opening through a side wall of a drilling mud flow conduit, thereby preventing flow of drilling mud through the opening. When the belling arms are in the drilling position, the valve means is moved to an open position whereby drilling mud can flow from the cavity through the opening and upwardly through the conduit, carrying the cuttings therewith.

8 Claims, 4 Drawing Figures

DRILLING AND BELLING APPARATUS

The present invention relates to a drilling and belling apparatus used for forming an enlarged bell-shaped cavity in a drill bore in a single pass of the apparatus in the bore. Such enlarged cavities are used for the formation of a footing or foundation as, for example, for offshore drilling rigs or platforms. This is accomplished by first drilling the bore as in a conventional manner and at the proper depth belling arms carried by the apparatus are moved outwardly and drill an enlarged conical or bell-shaped cavity. After the cavity has been formed, the belling arms are retracted and the apparatus is withdrawn from the bore.

Equipment for drilling and belling is known in the art. For example, that disclosed in U.S. Pat. No. 3,757,876, issued Sept. 11, 1973. The present invention provides an improvement for such an apparatus by providing an alternate flow path for the drilling fluid to flow through and carry away the cuttings. In the past the cuttings and drilling fluid had to flow downwardly past the pilot end of the drill through the annular space between the drill and the bore. Such annular space is a restricted flow path and requires a bore having a diameter greater than that of the drill stem end. This resulted in a loose fit and thereby wobbling of the drill with its attendant problems.

The principal objects and advantages of the present invention are: to provide a combination drilling and belling apparatus which is useful for drilling a bore and a belled cavity in one pass; to provide such an apparatus with an alternate flow path for drilling fluid and cuttings; to provide such an apparatus which is well adapted for its intended use, economical to manufacture and easy to maintain.

Other objects and advantages of the present invention will become apparent from the following detailed description taken in connection with the accompanying drawings wherein are set forth by way of illustration and example certain embodiments of the present invention.

Figure 1:
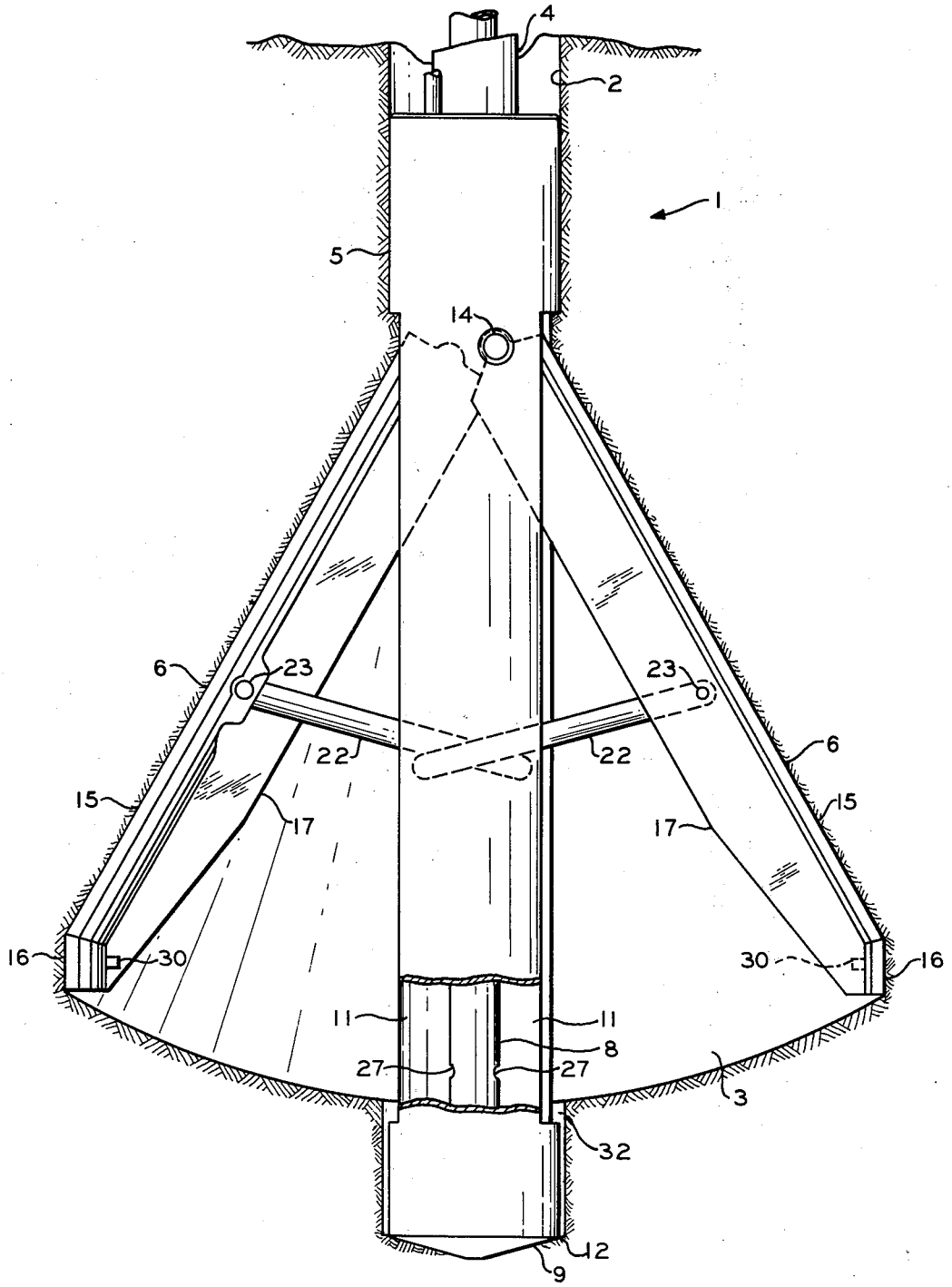
FIG. 1 is a side view of a drilling and belling apparatus showing belling arms in a drilling position. Sections of the apparatus are broken away to show structural details thereof.
Figure 2:
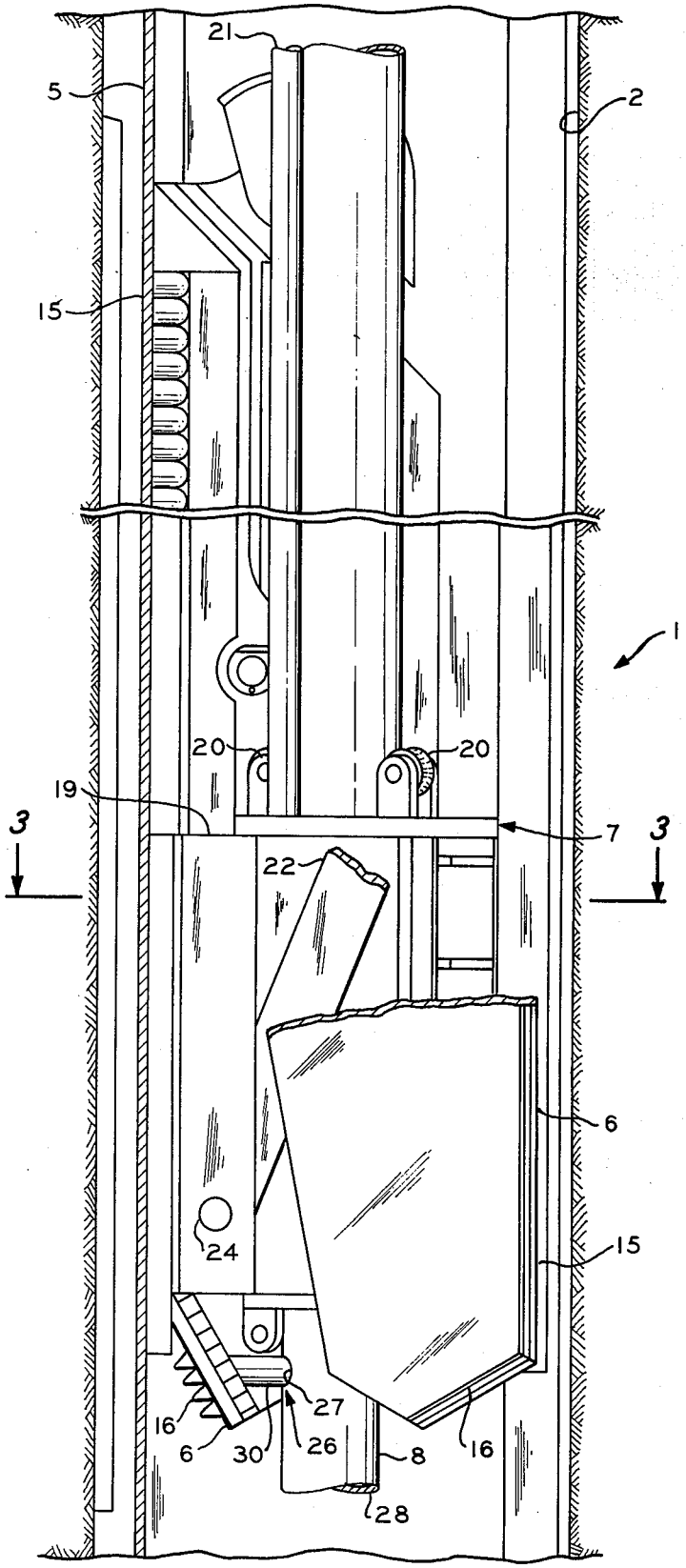
FIG. 2 is an enlarged fragmentary sectional view of the apparatus shown in FIG. 1 but with the belling arms in a non-drilling position.
Figure 3:
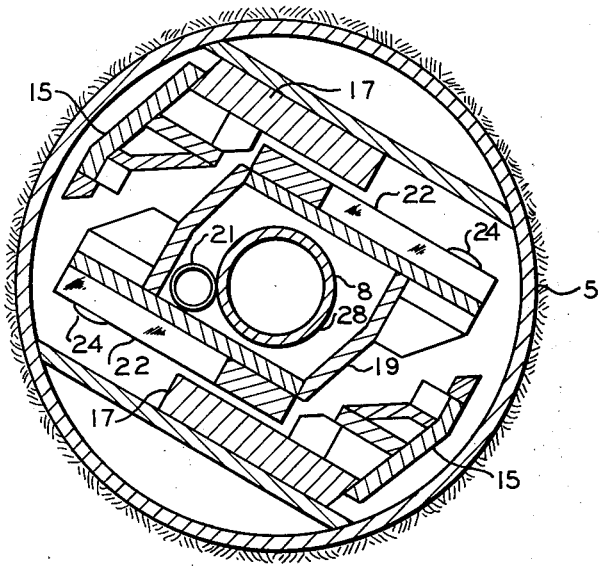
FIG. 3 is a sectional view taken along the line 3—3, FIG. 1, with the exception of the belling arms being in a non-drilling position.

The drilling and belling apparatus 1 is used to drill a bore 2 and a bell-shaped cavity 3. The apparatus 1 is secured to an end of a drill stem 4 which extends upwardly therefrom, in operation, to means for rotating the apparatus 1. The apparatus 1 includes a frame 5 which carries at least one belling arm 6 mounted for pivotal movement from an extended drilling position to a retracted non-drilling position. Activation means 7 is operably connected to the belling arm 6 for selectively moving same between the drilling and non-drilling positions. Also, a tubular member or conduit 8 is positioned interiorly of the stem 4 and frame 5 for a purpose to be later described. The apparatus 1 includes a drillng head or surface 9 at the lower end thereof which is adapted for drilling the earth to form the cylindrical bore 2. The apparatus 1 is similar to that disclosed in U.S. Pat. No. 3,757,876 which disclosure is incorporated herein by reference as disclosing a combination drilling and belling apparatus of this general type. Therefore, the specific details of the apparatus need not be disclosed herein.

In the illustrated structure the frame 5 is secured to the stem 4 in any suitable manner, as is known in the art. The frame 5 can be of any suitable type and preferably has a pair of generally opposed recesses 11 which preferably are about 180° apart. The recesses 11 extend longitudinally along the frame 5 and preferably terminate adjacent a free end 12 thereof, for example, the recess can terminate approximately four feet from the end 12. This length is such as to provide an adequate pilot in the bore 2 for stabilizing the apparatus 1 during the belling operation. Secured to the end 12 is the drilling head 9 which is operable for forming the cylindrical bore 2. Drilling heads are well known in the art and need not be further described herein. Preferably, the arms 6 are pivotally mounted on the frame 5 as by pivots 14 at the upper disposed end of the respective arm 6. Any suitable type of pivot can be used.

The arms 6 can be of conventional form, each having a drill surface or area comprised of two sections 15 and 16 with the drill surface 15 being on the outer disposed surface of the longitudinal edge of the arm 6 for forming the side of the bell-shaped cavity 3 and the drill surface 16 is adjacent the end of the arm 6 and in operation forms the bottom of the cavity 3. As shown, the arm 6 is somewhat L-shaped and has a flange 17 which is received within the respective recess 11 when the arm 6 is in its non-drilling position.

The actuation means 7 is operably connected to the arm 6 for selectively moving arm 6 between the extended drilling position and the retracted non-drilling position and can be of any suitable type. As shown a slide member 19 is longitudinally movable within the frame 5 and has guide means such as rollers 20 rotatably mounted thereon and engaging the tubular member 8 for guiding the axial movement of the slide 19. A rod 21 or the like is connected to the slide 19 and extends upwardly therefrom to the surface so as to move the slide 19 relative to the tubular member 8 to effect movement of the arms 6 by means described below. As shown, a link 22 is pivotally connected, as at 23, to the flange 17 of each arm 6 and each link 22 pivotally connected to the slide 19, as at 24. During upward movement of the slide 19 relative to the tubular member 8 and the frame 5, the arms 6 pivot about the respective pivot 14 outwardly as best seen in FIG. 1. Lowering of the slide 19 relative to the frame 5 and tubular member 8 effects retraction of the arms 6 to a position within their respective recess 11 and out of a drilling position.

Figure 4:
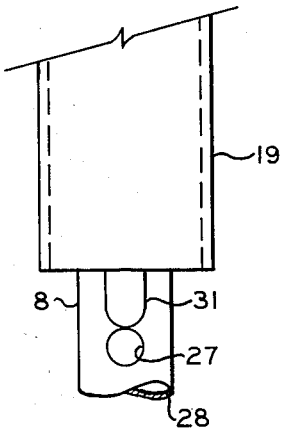
FIG. 4 is a fragmentary view of a modified form of the present invention.

The tubular member 8 is provided with one or more openings 27 which extend through the side wall 28 and form a flow path for flow communication between the interior and exterior of the tubular member 8. The openings 27 are spaced from the drill portion 9 a distance such that same open directly into the lower portion of the cavity 3 forming a flow path between the cavity and the interior of the tubular member 8. Valve means 26 is provided on each of the arms 6 so that when the arms 6 are in their non-drilling position, the valve means 26 fill, or otherwise substantially seal, the openings 27 and prevent the flow of drilling fluid and cuttings from the drilling operation therethrough. Therefore, the drilling fluid and cuttings flow along their normal path which is down the bore 2 around the frame 5 and into the bottom end of the bore 2 adjacent the drill portion 9 then through an open end 29 and upwardly through the tubular member 8. When the arms 6 move to their drilling position, i.e., out of the respective recess 11, the valve means 26 are moved away from the openings 27 so that the drilling fluid passes downwardly through the bore 2, through the frame 5 out into the cavity 3, and then through the openings 27 and upwardly through the tubular member 8. Any suitable valve means 26 can be used and as seen in FIG. 1, the valve means includes a valve member 30 carried by each of the arms 6 and each is in sealing relationship to the respective opening 27 when the arms 6 are in their non-drilling position. However, as seen in FIG. 4, an alternative embodiment is provided wherein a suitable valve member 31 is carried by the slide 19 and when the slide is in the down position, i.e., the arms 6 in their non-drilling position, the valve member 31 seals or closes the respective opening 27 thereby preventing the flow of drilling fluid and cuttings thereinto. As shown, the valve member 31 is of a slide type which moves over rather than into the opening 27, thus providing the seal for the openings 27.

In operation, the cylindrical bore 2 is drilled by the apparatus 1 by virtue of the cutting action of the drilling head or area 9 on the bottom end of the bore 2. The lower cylindrical portion 32 of the bore 2 acts as a guide or pilot for the frame and drill stem wherein the pilot portion 32 can be as long as four feet. This long of a pilot bore portion for the pilot is desirable since apparatuses like the apparatus 1 have large proportions as, for example, same can be 20 feet in length having belling arms up to or even longer than 15 feet. During the drilling of the bore 2, drilling fluid flows into the bottom of the bore 2 to pick up cuttings then carry the cuttings up the tubular member 8. When the proper depth of the bore 2 has been reached, drilling of the bore 2 is ceased and preferably reverse rotation of the apparatus 1 is then effected so that the cutting action of the head 9 is stopped. The arms 6, during reverse rotation, are moved outwardly to form the bell or conical shaped cavity 3. The arms 6 preferably have the drilling areas 15 and 16 so shaped as to drill in a direction of rotation opposite to that of the head 9. During the cavity drilling, after the openings 27 are open, the drilling fluid and cuttings flow through the openings 27 and into the tubular member 8 for discharge. When the proper size cavity 3 has been formed, i.e., by extension of the arms 6 to their fully extended drilling position, reverse rotation of the apparatus 1 is stopped, the arms 6 are moved inwardly to their non-drilling position and then the apparatus 1 is raised to the surface.

By not using an annular flow path between the frame 5 and a lower portion or pilot portion of the bore 2, a good fit is provided therebetween so as to prevent wobbling of the apparatus 1 during belling and drilling operations. Such a space has in the past been required during belling so that the cuttings and the drilling fluid could flow downwardly through the annular space and then upwardly through the tubular member 8. The openings 27 provide a more direct flow path while maintaining a good pilot fit between the frame 5 and the pilot portion of the bore 2.

It is to be understood that while I have illustrated and described certain forms of my invention, it is not to be limited to the specific form or arrangement of parts herein described and shown except to the extent that such limitations are found in the claims.

What is claimed and desired to be secured by Letters Patent is:

1. A belling drill including:

a frame having at a lower end thereof a first drill portion and having a recess in an outer surface of a side wall of the frame, said frame having a portion defining a first flow path;

at least one belling arm pivotally carried by said frame and having a second drill portion adapted for drilling an enlarged chamber in a drill hole, said belling arm being selectively movable between a retracted non-drilling position in said recess and an extended drilling position;

first means cooperating with said belling arm and operable for selectively moving said belling arm between said non-drilling position and said drilling position;

a tubular member positioned inside said frame and extending longitudinally along said frame, said tubular member defining a second flow path and having an open end adjacent the first drill portion for providing flow communication between said first and second flow paths, said tubular member having an elongate side wall with a through opening forming a third flow path between the interior and exterior of the tubular member for providing flow communication between said first and second flow paths; and valve means operably associated with said belling arm operable for closing said opening when said belling arm is in said non-drilling position for at least substantially preventing flow communication between said first and second flow paths through said opening.

2. A drill as set forth in claim 1 wherein:

there is a pair of said belling arms and a pair of said recesses with said belling arms being positioned relative to each other in generally opposed relation on said frame and with said recesses being positioned relative to each other in generally opposed relation in said frame.

3. A drill as set forth in claim 2 wherein:

said second drill portion includes a side drill surface and a bottom drill surface for drilling a side portion and a bottom portion respectively, of a bell shaped cavity.

4. A drill as set forth in claim 2 wherein:

said valve means includes a valve member mounted on at least one of said belling arms adapted for selectively closing said opening when said at least one belling arm having said valve member mounted thereon is in the non-drilling position.

5. A drill as set forth in claim 4 wherein:

said tubular member has a plurality of openings through the sidewall of said tubular member, and wherein said valve means comprises a plurality of valve members corresponding to the number of said openings, said valve members being positioned on at least one of said belling arms so as to close the respective openings when the at least one of said belling arms is in the non-drilling position.

6. A drill as set forth in claim 2 wherein said first means includes:

a slide member movably mounted in said frame for longitudinal movement in said frame and means operably connecting said slide member to said belling arms for moving said belling arms between the drilling and non-drilling positions in response to movement of said slide member.

7. A drill as set forth in claim 5 wherein:

said valve means includes a valve member carried by said slide member and operable for selectively closing said opening when said belling arms are in the non-drilling position.

8. A method of forming a cylindrical borehole and an enlarged bell-shaped cavity in the earth, said method including the steps of:

drilling a generally cylindrical borehole in the earth with a drill means having at least one belling arm portion;

flowing drilling fluid into and out of said borehole through a first flow path and second flow path, respectively, around a drill end portion of the drill means forming the bottom end of the borehole during drilling and thereby carrying away cuttings;

selectively forming an enlarged cavity about said borehole with at least one belling arm portion of said drill means at a desired depth by moving said at least one belling arm portion to an extended position during rotation of the drill means and thereby opening a third flow path through a side wall of a tubular member portion of the drill means, said tubular member portion defining one of said first flow path and said second flow path, said third flow path being spaced from the drill end portion of the drill means a distance such that the third flow path opens into the cavity and provides an alternative flow path, when open during belling, between said first and second flow paths and is normally closed during drilling of the borehole;

flowing drilling fluid into said cavity through one of said first flow path and second flow path and out of the cavity through the other of said first flow path and second flow path during formation of the cavity with the drilling fluid flowing between said first flow path and second flow path through said third flow path.

* * * * *